US006887590B2

(12) United States Patent
Zeizinger et al.

(10) Patent No.: US 6,887,590 B2
(45) Date of Patent: May 3, 2005

(54) GALVANNEALED METAL SHEET AND METHOD FOR MANUFACTURE OF SUCH METAL SHEET

(75) Inventors: Sabine Zeizinger, Duisburg (DE); Horst Berndsen, Duisburg (DE); Frank Friedel, Moers (DE); Manfred Meurer, Ratingen (DE); Michael Westholt, Castrop-Rauxel (DE)

(73) Assignee: ThyssenKrupp Stahl AG, Duisburg (DE)

( * ) Notice: Subject to any disclaimer, the term of this patent is extended or adjusted under 35 U.S.C. 154(b) by 191 days.

(21) Appl. No.: 10/276,151

(22) PCT Filed: May 15, 2001

(86) PCT No.: PCT/EP01/05472

§ 371 (c)(1),
(2), (4) Date: Apr. 1, 2003

(87) PCT Pub. No.: WO01/88216

PCT Pub. Date: Nov. 22, 2001

(65) Prior Publication Data

US 2003/0155048 A1 Aug. 21, 2003

(30) Foreign Application Priority Data

May 15, 2000 (DE) ..... 100 23 312

(51) Int. Cl.[7] ..... B32B 15/18; C21D 9/46

(52) U.S. Cl. ..... 428/659; 428/609; 428/939; 148/533; 148/534; 148/579; 148/601; 148/902

(58) Field of Search ..... 428/659, 609, 428/939; 148/533, 534, 579, 601, 902; 427/433, 436

(56) References Cited

U.S. PATENT DOCUMENTS

| | | | | |
|---|---|---|---|---|
| 5,578,143 | A | 11/1996 | Koyama et al. | |
| 5,897,967 | A | 4/1999 | Hori et al. | |
| 5,997,664 | A | * 12/1999 | Tahara et al. | 148/533 |

FOREIGN PATENT DOCUMENTS

| | | | |
|---|---|---|---|
| EP | 0681032 | A1 | 11/1995 |
| EP | 0822267 | A1 | 2/1998 |
| JP | 04041658 | A | 2/1992 |
| JP | 04346625 | A | 12/1992 |

OTHER PUBLICATIONS

Lompman, E.A.: ASM Handbook, Oct. 1995; ASM International; Metals Park, US; pp. 345–346.

* cited by examiner

*Primary Examiner*—Robert R. Koehler
(74) *Attorney, Agent, or Firm*—Proskauer Rose LLP

(57) ABSTRACT

The present invention relates to a method for the manufacture of galvannealed metal sheet, wherein a hot strip is produced from an IF steel containing 0.01 to 0.1 wt. % silicon, wherein the hot strip is coiled at a coiler temperature no lower than 700° C. and no higher than 750° C., wherein a cold strip is rolled from the coiled hot strip, wherein the cold strip is recrystallization-annealed in an annealing furnace in an annealing gas atmosphere, wherein the cold strip thus annealed is provided with a zinc coating in a zinc bath, and wherein the coated cold strip is post-annealed at a galvannealing temperature no lower than 500° C. and no higher than 540° C. The invention also relates to a galvannealed metal sheet which possesses improved adhesion of the coating layer to the base material and proposes a method which is suited for the manufacture of metal sheet having such properties.

12 Claims, 5 Drawing Sheets

GALVANNEALED METAL SHEET AND METHOD FOR MANUFACTURE OF SUCH METAL SHEET

BACKGROUND OF THE INVENTION

The invention relates to a method for the manufacture of galvannealed metal sheet which has been produced from IF steel. According to the conventional understanding, "galvannealed metal sheet" is understood as a hot-dip galvanised metal sheet marketed in the form of coils or blanks, which has been annealed after the hot dipping. The coating produced by this "galvannealing" process on the metal sheet base material usually only consists of iron-zinc compounds.

The term "IF (interstitial-free) steel" is understood as steels without interstitially dissolved alloying constituents which contain silicon and additional contents of titanium and/or niobium for the removal of the C and N atoms, in addition to other alloying constituents which may be required. Such steels are distinguished by good cold-formability as a consequence of a low yield point and are especially suited for the deep drawing of components.

Galvannealed metal sheet made of IF steel is used especially in the manufacture of automobile bodies. Here the highest requirements with respect to formability are imposed both on the base material and also on the coating applied thereto. Practice shows that with conventionally produced galvannealed metal sheet, increased abrasion occurs in the pressing tool. Regardless of the influences exerted by the specific forming conditions, this abrasion depends to a large extent on the steel composition and the conditions under which the steel has been produced. These production conditions directly influence the phase structure of the coating and thus the surface condition, homogeneity and strength with which the coating adheres to the base material.

Silicon contents of up to 0.1 wt. % are added to IF steels from which galvannealed metal sheet of the type under discussion is produced, to improve the adhesion of the zinc coating on the base material. As a result of the silicon alloying, a stronger grain-boundary occupancy is achieved. During forming these grain boundaries tear and form as such "preset breaking points" which prevent any further exfoliation of the coating.

The mechanical properties and with this, the forming behaviour of the base material are, however, worsened by the silicon alloying. For example, it was been established that the strength of the material deteriorates by respectively 1 $N/mm^2$ when the silicon content is respectively increased by 0.01 wt. %.

Other investigations have shown that in the case of galvannealed metal sheet produced from IF steel having only low Si contents, for example, 0.012 wt. % and at the same time Fe contents in the coating layer between 7 wt. % and 12 wt. %, the coating only adheres poorly to the base material. At higher iron contents in the coating and higher Al contents in the galvanising bath, a toothed structure could be observed at the steel/coating layer interface through which the adhesion of the coating to the base metal is supported.

In practice, however, the adhesion of the coating to the base material cannot be improved either by increasing the Al content in the zinc bath or by increasing the fractions of Fe in the coating layer. This is because a high Al content in the zinc bath leads to a substantial alloying delay in the galvannealed reaction. This delay can only be compensated by increased furnace temperatures and longer furnace transit times. Both measures incur increased operating costs, reduced economic efficiency and greater wear on the furnace.

Also high Fe contents in the coating can only be produced by high galvannealing temperatures and/or long holding times. This has the consequence that the coating layer contains a clearly identifiable layer of gamma phases. This gamma phase layer then adheres to the base metal with increased strength. However, between the gamma phase layer and the relatively very much thicker delta phase layer located thereon, there is some weakening of the adhesive strength. As a result, the thick delta phase layer thus peels away under a corresponding loading so that the abrasion increases and the protection of the base material desired with the coating is also not ensured.

A method of the type specified initially is basically known, for example, from DE 198 22 156 A1. In the known method a hot strip is hot-rolled from IF steel, coiled and rolled into a cold strip. The cold strip is then recrystallisation-annealed in an annealing furnace, before it is finally provided with a zinc coating in a zinc bath.

SUMMARY OF THE INVENTION

The object of the invention is to create a galvannealed metal sheet which possesses improved adhesion of the coating layer to the base material and to provide a method which is suited to the production of metal sheet of such quality.

On the basis of the prior art described above, this problem is solved, on the one hand, by a method for the production of galvannealed metal sheet wherein a hot strip is produced from an IF steel containing 0.01 to 0.1 wt. % silicon, wherein the hot strip is coiled at a coiler temperature not lower than 700° C. and not higher than 750° C., wherein a cold strip is rolled from the coiled hot strip, wherein the cold strip is recrystallisation-annealed in an annealing furnace in an annealing gas atmosphere, wherein the cold strip thus annealed is provided with a zinc coating in a zinc bath and wherein the coated cold strip is annealed at a galvannealing temperature no lower than 500° C. and no higher than 540° C.

In the procedure according to the invention the parameters of the individual procedural steps are adjusted such that the mechanical properties of the base material "IF steel" and the properties of the coating layer applied to the base material are optimally matched one to the other. In this way, galvannealed metal sheet is obtained which meets the highest requirements and as such is suited to withstand the greatest stresses during forming.

The invention is based on the knowledge that the oxidation state both of the hot strip and also of the cold strip surface substantially influences the action of the silicon, said action improving the adhesion of the coating. The oxidation state influences the kinetics of the Zn/Fe phase formation at the beginning of the galvanising process. If the phase formation takes place slowly, at the boundary between the steel base material and the coating layer there forms a structure in which the base material and the coating layer are closely dovetailed one with the other. The formation of such a toothed structure leads to a significant increase in the adhesion between coating and steel base material.

The adhesion is additionally promoted by the formation of a jagged coating. This form of coating layer also supports the adhesion of the coating on the base material.

Thermodynamic considerations have shown that near-surface oxides can be reduced by the Al dissolved in the Zn bath. In this case, part of the available aluminium does not contribute to the formation of an Fe—Al blocking layer. This is instead weakened and the Fe/Zn phase reaction accelerated.

In addition to this direct effect, the oxide particles also influence the recrystallisation sequence of the steel surface structure. This is because the fine oxides are capable of impeding the recrystallisation, if not of completely suppressing it. Titanium oxides are particularly effective in this respect. As a result of the recrystallisation being impeded, a fine-grained or completely repeated structure appears. With its grain size, the diffusion capability of its grain boundaries and its texture, the structure in turn influences the efficiency of the Fe/Al blocking layer. Thus, a repeated or fine-grained structure accelerates the phase reaction whereas a coarse, recrystallised structure can have a retarding influence.

After an internal oxidation, the surface is permeated to a certain depth with a plurality of fine oxides. These fine oxides accelerate the phase reaction in an undesirable fashion either directly or indirectly with their effects on the properties of the coating layer. It has been established that the internal oxidation can already take place below the scale in the hot strip and is not removed by the pickling of the hot strip.

In addition to its negative influence on the structure of the steel base material, the internal oxidation also has a negative influence on the homogeneity of the coating. Thus, among other things, the marbling of the coating layer is determined by the lateral distribution of the internal oxides.

The coiler temperature has a substantial influence on the formation of internal oxidation. By means of the selected range of coiler temperature according to the invention, the formation of internal oxidation is effectively avoided. The abrasion behaviour of the coating layer and the mechanical properties of the galvannealed metal sheet can thus be directly influenced by the coiler temperature. In this connection it has been found in practical tests that particularly good properties can be achieved if the coiler temperature is no less than 710° C. and no higher than 740° C.

Depending on the respective silicon content, the optimum coiler temperature range can be further limited. The permissible lowest coiler temperature should not be lower than 720° C. whereas 740° C. is still to be observed as the upper limit of the temperature range. It has been found that when the silicon contents of the IF steel used to produce the base material are in the range of 0.03–0.08 wt. % and the coiler temperatures are in the range of 710° C. or 720° C. up to 740° C. in each case, it is possible to produce galvannealed metal sheet having a particularly good abrasion behaviour with excellent mechanical properties at the same time.

Since in some cases, internal oxidation only starts in the course of the annealing before the galvanising, depending on the composition of the steel base material or the production conditions, it is unfavourable if the dew point of the annealing gas lies at a relatively high temperature. A high dew point of the annealing gas promotes undesirable internal oxidation.

At the same time, it should be noted that the external oxidation of the steel base material leads to larger particles at the steel surface which are favourable for the adhesion of the coating layer. In order that the process of large particle formation takes place during the cold strip annealing, the internal oxidation in the hot strip must be suppressed during the annealing. Thus, a low dew point in the annealing gas is set according to the invention. Accordingly, the dew point of the annealing gas from which the atmosphere is formed during the recrystallisation annealing, is arranged according to the invention in the range of −20° C. to −60° C., wherein according to a further optimised variant it lies in the region of −25° C. to −40° C.

In connection with the formation of oxides, it should additionally be mentioned that the roughness, adhesion and homogeneity of the coating are substantially influenced by the oxidation state of the cold strip surface before the galvanising. Here a distinction must be made between a direct and an indirect effect of oxidation particles. Titanium oxides, for example, considerably influence the homogeneity and roughness of the galvanising coating with the participation of the structure and the texture, whereas Si oxides have a direct effect on the adhesion of the coating to the base material. The silicon alloying element contained in the steel base material only exhibits its positive effect in relation to the adhesion of the coating if it can diffuse to the surface in an external oxidation process before the galvanising.

The cold-rolled strip annealed under the conditions described previously is preferably passed in the course of the annealing process through a zinc bath whose aluminium content lies in the range of 0.1 to 0.14 wt. %. The desired formation of a toothed structure in the vicinity of the transition from the steel base layer to the coating layer is favoured by the addition of such a fraction of Al to the Zn melt. Here, a further optimisation can be achieved if necessary, if the zinc bath contains 0.105 to 0.125 wt. % aluminium.

According to a development of the invention equally optimised in respect to the production result, the galvannealing temperature may lie in the range of 510° C. to 530° C.

The procedure for the production of galvannealed metal sheet according to the invention leads to a galvannealed product in which a toothed structure is formed in the region of the boundary between the steel base material and the coating layer through which an intimate binding of base material and coating layer is ensured. This intimate binding ensures that the coating adheres firmly to the steel base material so that as a result, metal sheet having particularly good mechanical properties and at the same, abrasion values reduced to a minimum is obtained.

With reference to the metal sheet, the problem specified previously is solved by a galvannealed metal sheet whose base material is formed of IF steel and in which a toothed structure is formed in the region of the metal sheet/zinc coating boundary, whose area fraction of the total area of the metal sheet is at least 50%. As explained in connection with the method according to the invention, the adhesion of the coating layer to the steel base material is improved by the presence of such a toothed structure so that the abrasion identifiable in metal sheet according to the invention is reduced compared with conventional metal sheet even for complex forming operations. Moreover, the strength with which the coating adheres to the steel base material increases as the area over which the toothed structure extends increases. Thus, metal sheet according to the invention for which the area fraction of the toothed structure accounts for at least 80% of the total area of the metal sheet exhibits especially good abrasion values.

Metal sheets according to the invention exhibit exceptional mechanical properties with respect to their intended purpose. Thus, its yield point is less than 170 N/mm$^2$ and its strength is less than 320 N/mm$^2$. Moreover, elongations of more than 39%, $r_q$ values (values of the respective anisotropy, measured transversely) of more than 1.80 and $n_q$ values (values of the respective hardening exponent, measured transversely) of more than 0.210 are achieved for the metal sheets according to the invention.

The method according to the invention is especially suited for the production of galvannealed metal sheets according to the invention.

BRIEF DESCRIPTION OF THE DRAWINGS

The invention is explained in the following with reference to the embodiments. The drawings show.

DETAILED DESCRIPTION OF THE INVENTION

Figure 1:
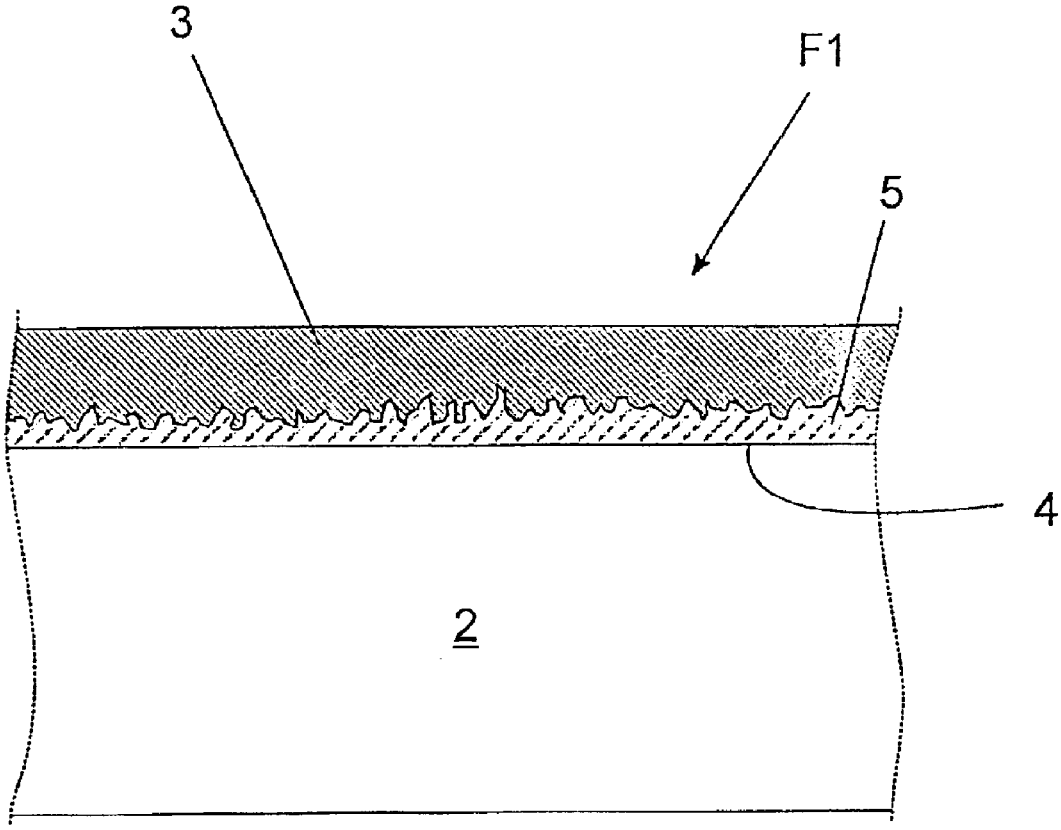
FIG. 1 is a schematic sectional view of a galvanised metal sheet according to the invention.
Figure 2:
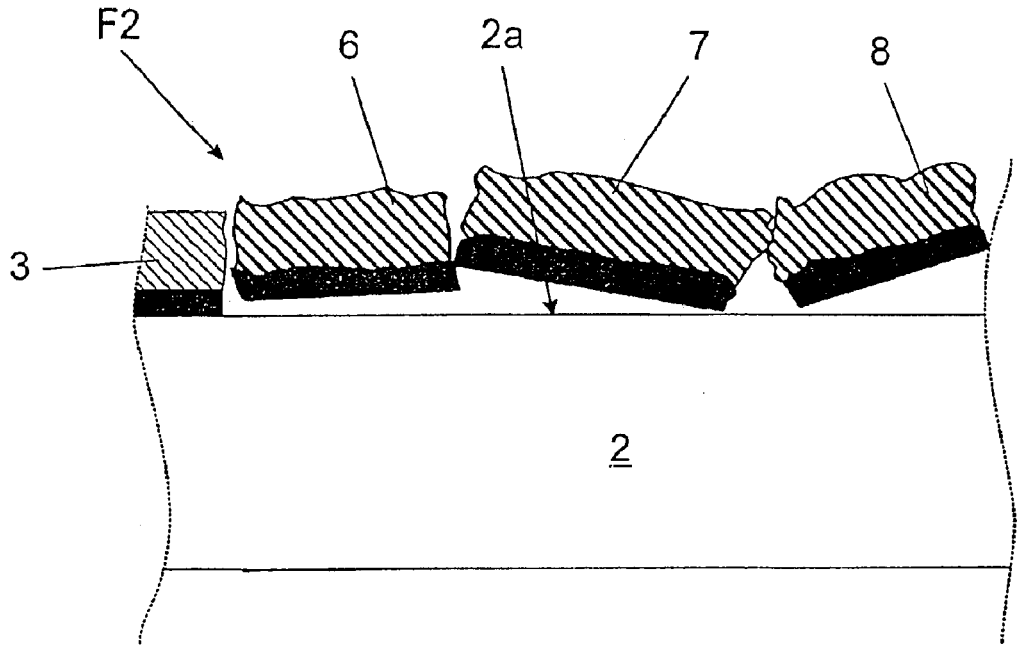
FIG. 2 is sectional view corresponding to FIG. 1 of a galvannealed metal sheet affected by abrasion corresponding to a first case of the development.
Figure 3:
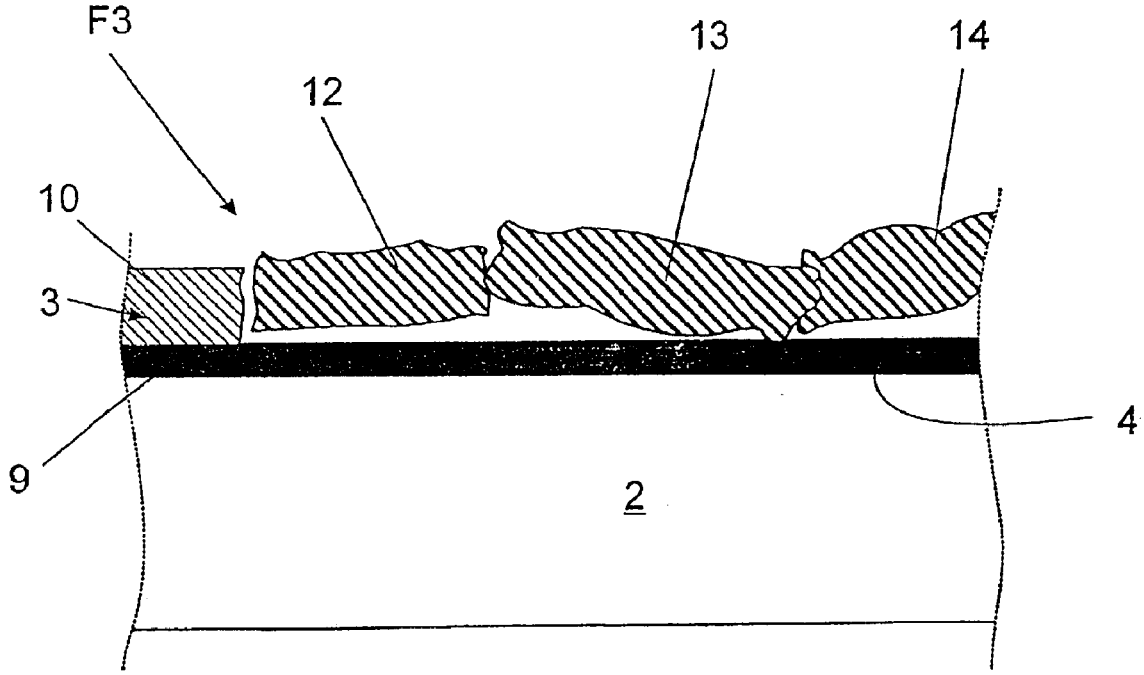
FIG. 3 is a schematic sectional view corresponding to FIGS. 1 and 2 of a galvannealed metal sheet affected by abrasion corresponding to a second case of the development.

The galvannealed metal sheets F1, F2 and F3 shown in FIGS. 1 to 3 each comprise a cold strip 2 produced from IF steel. This cold strip 2 forms the base material on which a coating layer 3 substantially consisting of zinc and iron-zinc compounds is applied.

Figure 4:
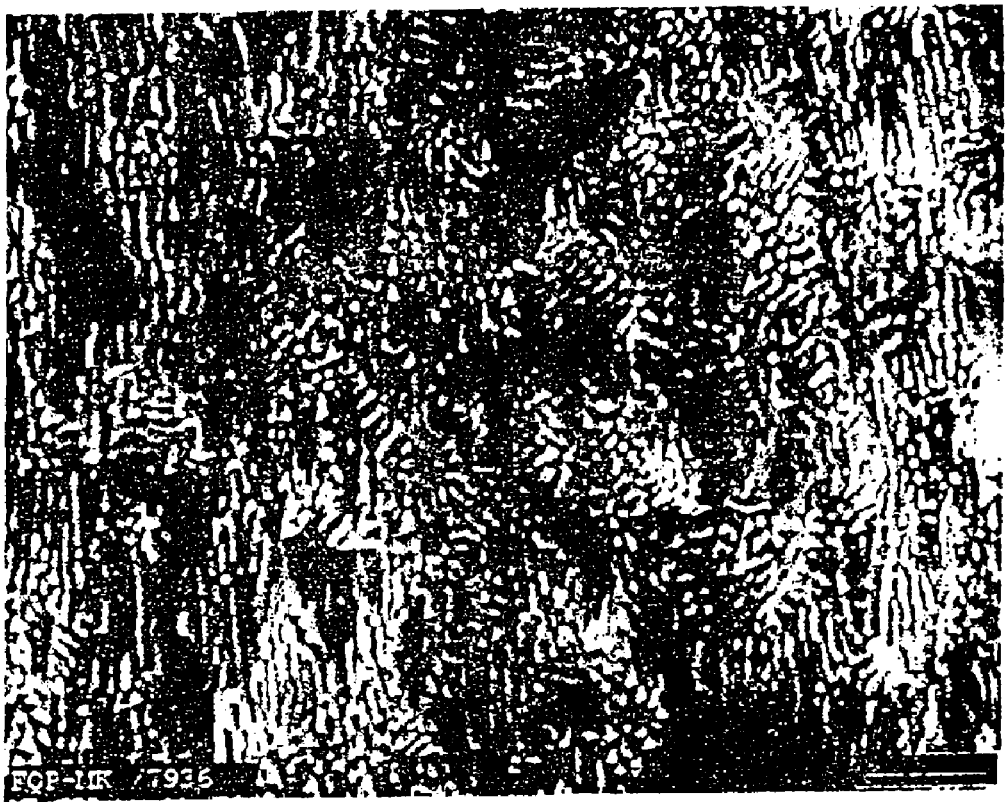
FIG. 4 is an enlarged view of a region of the transition from the steel base material to the coating layer in the galvannealed metal sheet according to the invention.

In the metal sheet F1 according to the invention shown in FIG. 1, in the course of the production of the metal sheet F1 a toothed structure 5 has formed as a result of a slowly progressing Zn/Fe phase formation in the region of the boundary 4 between the cold strip 2 and the coating layer 3, of which an enlarged photograph obtained from a practical example is shown in FIG. 4. This toothed structure extends over at least 50%, preferably more than 80% of the total area of the metal sheet. The coating layer 3 and the cold strip 2 are firmly adhered one to the other via the toothed structure 5. The close toothing of the cold strip 2 and coating layer 3 or the formation of the toothed structure 5 is the consequence of the formation of Zn/Fe phases which "grow into" the coating layer. In this way the coating layer 3 is intensively clamped with the cold strip 2 and ensures that the coating layer 3 is held firmly on the cold strip 2. The frequency of the occurrence of abrasion in the forms illustrated in FIGS. 2 and 3 is reduced to a minimum for the galvannealed metal sheet F1 according to the invention because of the narrow toothed structure of the coating layer 3 and the cold strip 2.

Figure 5:
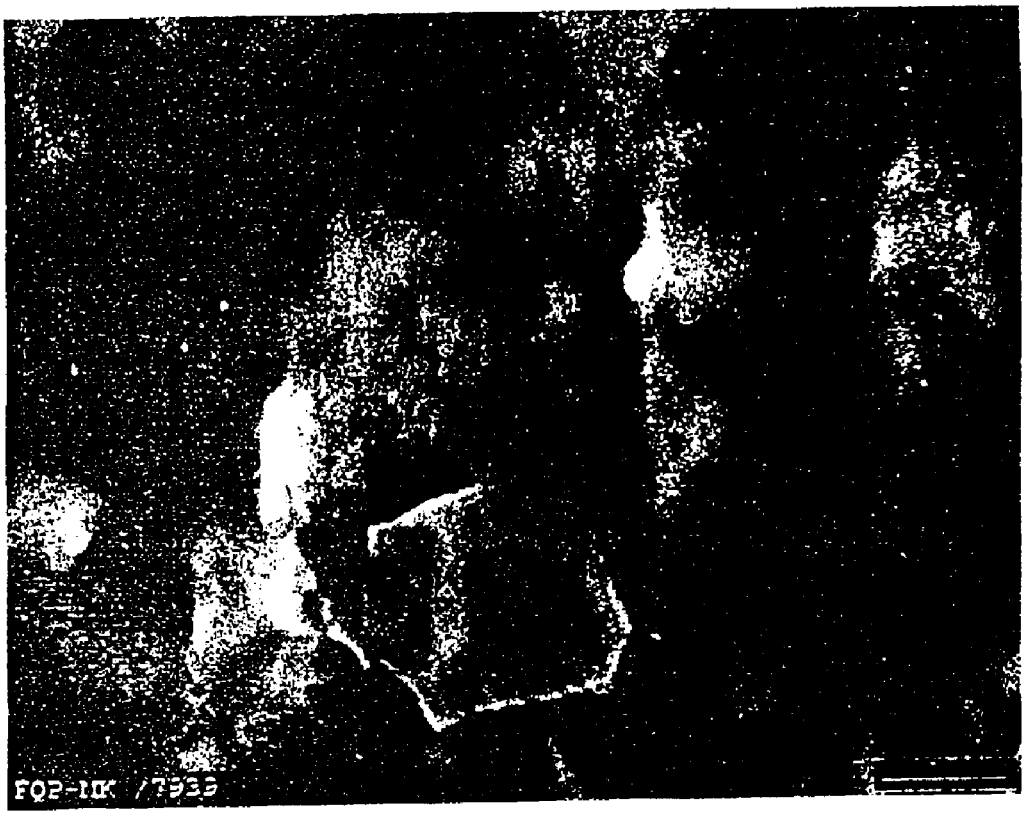
FIG. 5 is an enlarged view of a region of the transition from the steel base material to the coating layer corresponding to FIG. 3 in galvannealed metal sheet not according to the invention.
Figure 6:
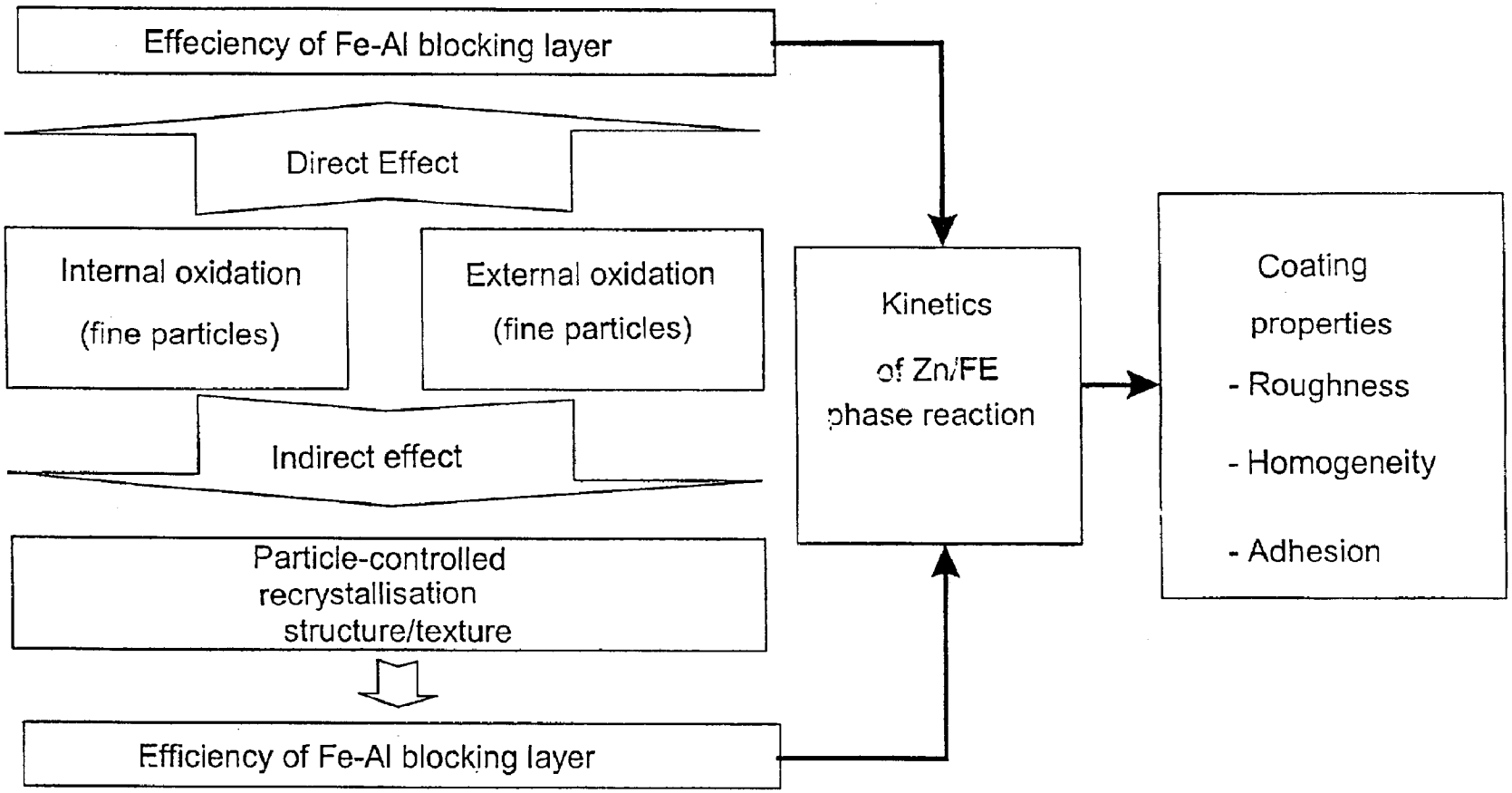
FIG. 6 is a diagram showing the influences of the internal and external oxidation on the kinetics of the Zn/Fe phase reaction and thus on the properties of the coating with which the galvannealed metal sheet according to the invention is provided.

The case of abrasion shown in FIG. 2 typically occurs in conventionally produced galvannealed metal sheets. As can be seen from FIG. 5, these have no toothed structure between the coating layer 3 and the cold strip 2 so that no positive clamping of cold strip 2 and coating layer 3 is present. Consequently, the coating layer 3 breaks into individual platelets 6, 7, 8 which peel away from the cold strip 2, for example, as a result of the stresses produced in the course of the forming of the metal sheet F2. The thickness of these platelets 6, 7, 8 substantially corresponds to the thickness of the coating layer 3. This has the consequence that the surface 2*a* of the cold strip 2 is completely unprotected after the platelets 6, 7, 8 have peeled away. This form of abrasion is called "flaking 1".

In the run-up to the development of the form of abrasion shown in FIG. 3, an attempt has been made to improve the adhesion of the coating layer 3 on the cold strip 2 by increasing the Fe content in the coating layer 3. Consequently, at the interface 4 between the cold strip 2 and the coating layer 3, a relatively thick layer 9 of gamma phases has formed in the coating. On this layer 9 lies a delta phase layer 10. In this case, there is no intensive intimate binding between the layer 9 and the layer 10 whereas the gamma phase layer 9 is firmly linked to the cold strip 2. This has the consequence that, for example, as a result of any forming, the uppermost lying delta-phase layer 10 peels away from the underlying gamma-phase layer 9 in the form of flake-like platelets 12, 13, 14. After the platelets 12, 13, 14 have peeled away, only the very much thinner gamma-phase layer 9 compared with the delta-phase layer 10 protects the surface of the cold strip 2 in this region. This form of abrasion is known as "flaking 2".

The procedure according to the invention will now be explained with reference to a practical example:

An IF Steel Containing (in wt. %)

| C | Si | Mn | P | S | Al | Nb | Ti |
|---|---|---|---|---|---|---|---|
| 0.004 | 0.05 | 0.12 | 0.01 | 0.008 | 0.038 | 0.023 | 0.06 |

the remainder iron and conventional impurities, was cast continuously and divided into slabs. These were then heated to a temperature of 1150° C. in the heating furnace of a multi-stage wide-strip hot-rolling mill.

After heating, the slabs were rolled to form hot strip in the hot-rolling line of the wide-strip hot-rolling mill. The end rolling temperature here was 905° C. At the end of the wide-strip hot-rolling mill the hot strip was coiled to form a coil at a temperature of 730° C.

The scale adhering to the hot strip was removed after the coiling in a continuously operating pickling plant.

After pickling, the hot strip was cold-rolled to form a cold strip having a strip thickness of 0.7 mm, for example, in a multi-stage cold strip rolling mill with a total degree of deformation of 75%.

The cold strip was then annealed and galvanised in a continuous hot-dip galvanising line. Here the cold strip was first cleaned of residual contamination from the cold rolling process in a cleaning section. The cleaned cold strip then passed through an annealing furnace in which it was heated to a temperature of 820° C. in an atmosphere formed of protective gas. The dew point of the protective gas was −25° C. After cooling to 480° C., the strip was dipped in a zinc bath which was at a temperature of 460° C. The zinc bath contains 0.12% aluminium. After withdrawing the coated cold strip from the zinc bath, the thickness of the zinc coating layer was adjusted to 7 $\mu$m by means of a jet processing device. Following the galvanising, the strip underwent post-annealing at a galvannealing temperature of 530° C. An inductively operating heating zone and a resistance-heated holding section were available for this purpose.

After this "galvanneal"-treated sheet metal strip had been cooled to a temperature of less than 50° C., the roughness of the cold strip was adjusted in a skin-pass stand.

The galvannealed metal sheet was then oiled in an after-treatment section and finally coiled to form a finished coil.

In accordance with the procedure described previously as an example, several series of tests have been carried out, whose results are presented in Tables 1 to 4. Tests 1 to 31, whose results and operating parameters are given in Tables 1 to 3, were carried out as simulation tests whereas the parameters and results given for tests 32 to 38 in Table 4 relate to operating tests.

For each test Tables 1 to 4 give the serial number of the test, the Si content of the IF steel used, the coiler temperature, the dew point of the annealing gas under which the recrystallisation annealing has been carried out, the galvannealing temperature, the yield strength, the tensile strength, the breaking elongation, the $r_q$ value, $n_q$ value, the area fraction of the toothed structure and the abrasion. In the "Remarks" column in Tables 2 to 4 it is also indicated whether the particular example belongs to the invention (characteristic "E").

The abrasion was determined in the strip drawing test. In this case, the sample was tested using a drawbead. The abrasion determined can be classified as follows into three grades:

| | |
|---|---|
| Very good: | <3 g/m$^2$ |
| Good: | 3–5 g/m$^2$ |
| Poor: | >5 g/m$^2$ |

The results given in Table 1 were obtained for a Ti/Nb IF steel having an Si content of 0.01 wt. %. In the relevant tests 1 to 9, none or only very small fractions of toothed structure of maximum 20% were observed at the steel/coating interface, which leads to moderate to poor abrasion results in the strip drawing test (compare with FIG. 5). Higher galvannealing temperatures (550° C.) and/or higher dew points (10° C.) resulted in stronger abrasion where "flaking 2" was observed especially at high galvannealing temperatures.

The mechanical properties especially at the high coiler temperatures of 770° C. are at a very good level, i.e., yield point values <150 N/mm$^2$, strengths of <315 N/mm$^2$, elongations >41%, $r_q$ values >1.85 and $n_q$ values >0.220. The abrasion values are poor however.

Nevertheless, the test results presented in Table 1 confirm that the procedure according to the invention reliably yields clearly improved abrasion behavior compared with the other test results with, at the same time, clearly improved forming properties even with steels having particularly low Si contents (Example 5).

Table 2 relates to tests 10 to 22 using steels which contained 0.05 wt. % Si. A coiler temperature of 730° C. combined with a dew point of −25° C. and a galvannealing temperature of 515° C. lead to marked toothed structures of 90 to 100% (FIG. 4) and thus to excellent abrasion values of <3 g/m$^2$. At the same time, very good mechanical properties are also achieved, i.e., yield point values <170 N/mm$^2$, strengths of <320 N/mm$^2$, elongations >39%, $r_q$ values >1.80 and $n_q$ values >0.210 (examples 11–14, 16–18 and 21). For example 10 produced according to the invention, values the formability could be identified with an abrasion value which located in the upper central part of the good range. However, this example has a yield point slightly higher than 170 N/mm$^2$. For example 15 a good abrasion result is achieved but the sample is not completely alloyed as is necessary for galvannealed metal sheet. For example 19 increased abrasion occurs ("flaking 2") since this sample was annealed at a higher galvannealing temperature and a thick, brittle gamma layer had formed at the steel/coating interface. Example 20 also was not regarded as according to the invention since overlarge abrasion was established in this case.

Table 3 contains the results of tests 23 to 31 using steels containing 0.08 wt. % Si. Here also very good abrasion values were only achieved (example 27) when coiler temperature, dew point and galvannealing temperature were matched according to the invention. The mechanical properties of this sample were also at a good level.

Table 4 gives results of operating tests 32 to 38. The results of the samples confirm the results obtained in the simulation tests 1 to 31 (Tables 1 to 3). Examples 33 and 34 according to the invention show extremely good abrasion values with very good mechanical properties at the same time.

TABLE 1

| Test | Si Content [Wt %] | Coiler Temp. [° C.] | Dew Point [° C.] | Galvannealing Temperature [° C.] | Yield Point [N/mm$^2$] | Tensile Strength [N/mm$^2$] | Elongation [%] | $r_q$ Value | $n_q$ Value | Area Fraction toothed structure [%] | Abrasion | Remarks |
|---|---|---|---|---|---|---|---|---|---|---|---|---|
| 1 | 0.01 | 710 | −40 | 480 | 153 | 303 | 40.1 | 1.78 | 0.214 | 0 | 4.3 | |
| 2 | 0.01 | 710 | −40 | 550 | 163 | 321 | 39.3 | 1.80 | 0.211 | 20 | 14.3 | * |
| 3 | 0.01 | 710 | −10 | 550 | 161 | 315 | 39.7 | 1.82 | 0.210 | 0 | 12.2 | * |
| 4 | 0.01 | 710 | −10 | 480 | 172 | 328 | 41.2 | 1.85 | 0.212 | 0 | 18.4 | |
| 5 | 0.01 | 730 | −25 | 515 | 158 | 317 | 41.3 | 1.87 | 0.214 | 0 | 5.5 | E |
| 6 | 0.01 | 770 | −10 | 550 | 141 | 312 | 42.0 | 1.85 | 0.220 | 0 | 20.3 | * |
| 7 | 0.01 | 770 | −10 | 480 | 139 | 309 | 42.0 | 1.94 | 0.222 | 0 | 25.2 | |
| 8 | 0.01 | 770 | −40 | 480 | 140 | 310 | 43.0 | 1.90 | 0.224 | 0 | 13.2 | |
| 9 | 0.01 | 770 | −40 | 550 | 142 | 313 | 41.5 | 2.02 | 0.221 | 0 | 14.7 | * |

* = Flaking 2

E = Invention

TABLE 2

| Test | Si Content [Wt %] | Coiler Temp. [° C.] | Dew Point [° C.] | Galvan-nealing Temperature [° C.] | Yield Point [N/mm$^2$] | Tensile Strength [N/mm$^2$] | Elon-gation [%] | $r_q$ Value | $n_q$ Value | Area Fraction toothed structure [%] | Abrasion | Remarks |
|---|---|---|---|---|---|---|---|---|---|---|---|---|
| 10 | 0.05 | 710 | −25 | 515 | 171 | 314 | 39.7 | 1.84 | 0.212 | 80 | 3.6 | E |
| 11 | 0.05 | 730 | −25 | 515 | 156 | 315 | 40.3 | 1.93 | 0.216 | 90 | 2.7 | E |
| 12 | 0.05 | 730 | −25 | 515 | 159 | 314 | 42.0 | 1.88 | 0.219 | 90 | 2.4 | E |
| 13 | 0.05 | 730 | −25 | 515 | 161 | 318 | 40.7 | 1.95 | 0.218 | 100 | 1.8 | E |
| 14 | 0.05 | 730 | −25 | 515 | 162 | 319 | 41.4 | 1.98 | 0.217 | 100 | 1.3 | E |
| 15 | 0.05 | 730 | −25 | 480 | 169 | 321 | 41.9 | 1.91 | 0.214 | 80 | 2.2 | ** |
| 16 | 0.05 | 730 | −25 | 515 | 164 | 319 | 42.6 | 1.90 | 0.216 | 100 | 2.0 | E |
| 17 | 0.05 | 730 | −25 | 515 | 155 | 316 | 41.2 | 1.92 | 0.220 | 100 | 1.7 | E |
| 18 | 0.05 | 730 | −25 | 515 | 157 | 314 | 41.7 | 1.84 | 0.219 | 100 | 2.8 | E |
| 19 | 0.05 | 730 | −25 | 550 | 156 | 320 | 42.5 | 1.90 | 0.221 | 100 | 9.3 | * |
| 20 | 0.05 | 730 | −10 | 515 | 154 | 316 | 42.6 | 1.89 | 0.223 | 10 | 14.2 | |
| 21 | 0.05 | 730 | −40 | 515 | 152 | 314 | 41.0 | 1.94 | 0.220 | 100 | 2.6 | E |
| 22 | 0.05 | 770 | −25 | 515 | 148 | 296 | 42.3 | 2.06 | 0.229 | 30 | 16.0 | |

* = Flaking 2
** = Not completely alloyed
E = Invention

TABLE 3

| Test | Si Content [Wt %] | Coiler Temp. [° C.] | Dew Point [° C.] | Galvan-nealing Temperature [° C.] | Yield Point [N/mm$^2$] | Tensile Strength [N/mm$^2$] | Elon-gation at rapture [%] | $r_q$ Value | $n_q$ Value | Area Fraction toothed structure [%] | Abrasion | Remarks |
|---|---|---|---|---|---|---|---|---|---|---|---|---|
| 23 | 0.08 | 710 | −10 | 550 | 165 | 328 | 40.4 | 1.83 | 0.213 | 10 | 13.3 | * |
| 24 | 0.08 | 710 | −40 | 480 | 159 | 321 | 39.6 | 1.78 | 0.209 | 100 | 3.5 | ** |
| 25 | 0.08 | 710 | −10 | 480 | 164 | 327 | 39.4 | 1.76 | 0.212 | 0 | 20.0 | |
| 26 | 0.08 | 710 | −40 | 550 | 162 | 322 | 40.8 | 1.85 | 0.207 | 100 | 10.8 | * |
| 27 | 0.08 | 730 | −25 | 515 | 161 | 315 | 40.9 | 1.89 | 0.218 | 100 | 2.1 | E |
| 28 | 0.08 | 770 | −10 | 480 | 156 | 311 | 42.1 | 2.03 | 0.215 | 0 | 15.8 | |
| 29 | 0.08 | 770 | −10 | 550 | 148 | 312 | 42.3 | 2.05 | 0.213 | 0 | 18.3 | |
| 30 | 0.08 | 770 | −40 | 550 | 146 | 311 | 42.6 | 1.97 | 0.212 | 10 | 21.3 | |
| 31 | 0.08 | 770 | −40 | 480 | 151 | 310 | 41.0 | 1.95 | 0.221 | 10 | 14.9 | |

* = Flaking 2
** = Not completely alloyed
E = Invention

TABLE 4

| Test | Si Content [Wt %] | Coiler Temp. [° C.] | Dew Point [° C.] | Galvan-nealing Temperature [° C.] | Yield Point [N/mm$^2$] | Tensile Strength [N/mm$^2$] | Elon-gation at rapture [%] | $r_q$ Value | $n_q$ Value | Area Fraction toothed structure [%] | Abrasion | Remarks |
|---|---|---|---|---|---|---|---|---|---|---|---|---|
| 32 | 0.006 | 715 | −28 | 526 | 171 | 322 | 39.8 | 1.78 | 0.205 | 0 | 4.7 | |
| 33 | 0.048 | 735 | −32 | 520 | 162 | 314 | 40.9 | 1.85 | 0.214 | 100 | 2.3 | E |
| 34 | 0.072 | 724 | −29 | 522 | 160 | 318 | 41.4 | 1.92 | 0.215 | 100 | 3.0 | E |
| 35 | 0.072 | 724 | −29 | 498 | 154 | 312 | 41.1 | 1.85 | 0.214 | 90 | 1.8 | ** |
| 36 | 0.072 | 724 | −29 | 562 | 153 | 316 | 41.0 | 1.89 | 0.217 | 100 | 7.8 | * |
| 37 | 0.055 | 770 | −33 | 524 | 145 | 314 | 42.3 | 2.01 | 0.225 | 0 | 8.5 | |
| 38 | 0.084 | 770 | −26 | 528 | 146 | 311 | 41.8 | 2.05 | 0.218 | 0 | 7.2 | |

* = Flaking 2
** = Not completely alloyed
E = Invention

What is claimed is:

1. A method for the manufacture of galvannealed metal sheet, wherein a hot strip is produced from an IF steel containing 0.01 to 0.1 wt. % silicon, wherein the hot strip is coiled at a coiler temperature no lower than 700° C. and no higher than 750° C., wherein a cold strip is rolled from the coiled hot strip, wherein the cold strip is recrystallisation-annealed in an annealing furnace in an annealing gas atmosphere, wherein the cold strip thus annealed is provided with a zinc coating in a zinc bath, and wherein the coated cold strip is post-annealed at a galvannealing temperature no lower than 500° C. and no higher than 540° C.

2. The method according to claim 1, characterised in that coiler temperature is no lower than 710° C. and no higher than 740° C.

3. The method according to claim 2, characterised in that coiler temperature is no lower than 720° C.

4. The method according to claim 1, characterized in that the dew point of the annealing gas from which the atmosphere is formed during the recrystallisation annealing is in the range of −20° C. to −60° C.

5. The method according to claim 4, characterised in that the dew point of the atmosphere under which the recrystallisation annealing is carried out, is in the range of −25° C. to −40° C.

6. The method according to claim 1, characterized in that the galvannealing temperature lies in the range of 510° C. to 530° C.

7. The method according to claim 1, characterized in that the zinc bath contains 0.1 to 0.14% aluminium.

8. The method according to claim 7, characterised in that the zinc bath contains 0.105 to 0.125 wt. % aluminium.

9. A metal sheet made of IF steel provided with a zinc coating wherein in the region of the metal sheet/zinc coating interface, there is formed an intimate toothed structure whose area fraction is at least 50% of the total area of the metal sheet.

10. The metal sheet according to claim 9, characterised in that it has yield point values of less than 170 $N/mm^2$, strength values of less than 320 $N/mm^2$, elongations of more than 39%, rq values greater than 1.80 and nq values greater than 0.210.

11. The metal sheet according to claim 9, characterized in that the area fraction of the toothed structure is at least 80% of the total area of the metal sheet.

12. The metal sheet according to claim 8, characterized in that it is manufactured according to the method according to claim 1.

* * * * *